US005971724A

United States Patent [19]

Choi

[11] Patent Number: 5,971,724

[45] Date of Patent: Oct. 26, 1999

[54] HERMETIC RECIPROCATING COMPRESSOR HAVING AN OIL GUIDING PATH

[75] Inventor: Yongyo Choi, Suwon, Rep. of Korea

[73] Assignee: Samsung Electronics Co., Ltd., Suwon, Rep. of Korea

[21] Appl. No.: 08/951,965

[22] Filed: Oct. 16, 1997

[30] Foreign Application Priority Data

Oct. 17, 1996 [KR] Rep. of Korea ..... 96-46599

[51] Int. Cl.[6] ..... F04B 35/04

[52] U.S. Cl. ..... 417/415; 184/6.6

[58] Field of Search ..... 417/415; 184/6.6, 184/6.8

[56] References Cited

U.S. PATENT DOCUMENTS 5,118,263 6/1992 Fritchman ..... 417/415

*Primary Examiner*—Charles G. Freay
*Attorney, Agent, or Firm*—Burns, Doane, Swecker & Mathis, L.L.P.

[57] ABSTRACT

A hermetic reciprocating compressor is provided. The compressor comprises: a hermetic casing formed with an oil container at the bottom thereof; a driving motor having a stator installed inside the casing, a rotor rotatably installed inside the stator and a rotating shaft rotating with the rotor, the rotor having a journal and an eccentric portion; a sliding bearing for supporting the rotation of the journal of the rotating shaft; an oil pickup device extending downward from a lower end portion of the eccentric portion, for supplying a lubricating oil contained in the oil container between the journal of the rotating shaft and the bearing; and a medium compressing portion having a cylinder block which is provided with a cylinder, a piston reciprocating inside the cylinder and a connecting rod for connecting the piston to the eccentric portion of the rotating shaft to convert the rotational movement of the rotating shaft into the reciprocating movement of the piston inside the cylinder, wherein the cylinder block has at least one oil guiding path for guiding the lubricating oil flowing downward along the outer surface of the bearing into the oil container. Accordingly, collection and boiling of the oil on the cylinder block can be prevented, thereby preventing noises and deterioration of the oil. Furthermore, part of the oil returning to the oil container is directed to the connecting rod, thereby enhancing the lubricating efficiency.

3 Claims, 4 Drawing Sheets

HERMETIC RECIPROCATING COMPRESSOR HAVING AN OIL GUIDING PATH

BACKGROUND OF THEY INVENTION

The present invention relates to a hermetic reciprocating compressor.

A hermetic reciprocating compressor is generally employed in a cooling system such as a refrigerator or an air conditioner, so as to compress a gaseous refrigerant from an evaporator to a high temperature and high-pressure state and supply the compressed refrigerant to a condenser.

FIG. 4 shows a sectional view of a conventional hermetic reciprocating compressor. As shown in FIG. 4, the conventional compressor includes a casing 51 forming a closed internal space, a cylinder apparatus for receiving, compressing and discharging a refrigerant and a driving motor for driving the cylinder apparatus.

The driving motor includes a stator 52 around which an exciting coil is wound and a rotor 53 having a permanent magnet. The rotor 53 is rotatably installed inside the stator 52. A rotating shaft 54 is fitted into the rotor 53 and rotates therewith.

A journal 54*a* is formed at the lower portion of the rotating shaft 54 and rotatably supported by a bearing 55. An eccentric portion 54*b* is formed at the lower end portion of the journal 54*a* and an oil pickup tribe 60 is extended downwardly front the eccentric portion 54*b*. The oil pickup tube 60 picks tip a lubricating oil contained in an oil container 61 provided at the bottom of the casing 51 and supplies the oil between the journal 54*a* and the bearing 55 when the rotating shaft 54 rotates. A spiral oil groove 62 is formed on the surface of the journal 54*a* of the rotating shaft 54 to facilitate the upward flow of the oil.

The cylinder apparatus has a cylinder 56*a* which is provided at a cylinder block 56 for supporting the driving motor and a piston 57 which reciprocates inside the cylinder 56*a*. The bearing 55 is installed on the cylinder block 56. The piston 57 is connected to the eccentric portion 54*b* of the rotating shaft 54 via a connecting rod 58, to thereby convert the rotational movement of the rotating shaft 54 into the reciprocating movement of the piston 57.

FIG. 5 shows a plan viewed of the conventional bearing 55. As shown in FIGS. 4 and 5, the bearing 55 has a cylindrical bearing body 67 for rotatably supporting the journal 54*a* of the rotating shaft 54 and a flange 68 formed at a lower portion of the bearing body 67. The flange 68 is installed on the cylinder block 56 by a bolting structure. A plurality of holes 66 are formed at the flange 68 to receive bolts (not shown) for the bolting structure.+ An oil discharging groove 63 is formed at an upper portion of the rotating shaft 54 to discharge the oil moving upward from between the rotating shaft 54 and the journal 54*a*. The lubricating oil discharging through the oil discharging groove 63 flows downward alone the outer stirface of the bearing 55, is collected on the cylinder block 56 and then overflows from the cylinder block 56 into the oil container 61.

However, the oil which is collected on the cylinder block 56 is boiled by the cylinder 56 block which is heated to a high temperature during the compressing process of the refrigerant. The boiling of the oil generates noises and deteriorates characteristics of the oil.

SUMMARY OF THE INVENTION

It is an object of the present invention to provide a hermetic reciprocating compressor which is capable of preventing a lubricating oil from being collected on a cylinder block to thereby prevent noises and deterioration of the oil.

It is another object of the present invention to provide a hermetic reciprocating compressor which is capable of supplying the oil returning to an oil container to a connecting rod, thereby enhancing the lubricating efficiency of a cylinder apparatus.

To accomplish the above objects, there is provided a hermetic reciprocating compressor comprising:

- a hermetic casing formed with an oil container at the bottom thereof;
- a driving motor having a stator installed inside the casing, a rotor rotatably installed inside the stator and a rotating shaft rotating with the rotor, the rotor having a journal and an eccentric portion;
- a sliding bearing for supporting the rotation of the journal of the rotating shaft;
- an oil pickup device extending downward from a lower end portion of the eccentric portion, for supplying a lubricating oil contained in the oil container between the journal of the rotating shaft and the bearing; and
- a medium compressing portion having a cylinder block which is provided with a cylinder, a piston reciprocating inside the cylinder and a connecting, rod for connecting the piston to the eccentric portion of the rotating shaft to convert the rotational movement of the rotating shaft into the reciprocating movement of the piston inside the cylinder, wherein the cylinder block has at least one oil guiding path for guiding the lubricating oil flowing downward along the outer surface of the bearing into the oil container.

Here, it is preferable that the oil guiding paths are first oil guiding holes formed at the cylinder block and that the bearing has a flange formed at a lower portion thereof and installed on the cylinder block, the flange having second oil guiding holes corresponding to the first oil guiding holes of the cylinder block.

Preferably, at least one of the first oil guiding holes is located such that the lubricating oil passing therethrough drops toward the connecting rod.

It is also preferable that an oil discharging groove is formed at an upper end portion of the bearing for discharging the lubricating oil from the bearing and an oil guiding groove is formed on the outer surface of the bearing for guiding the lubricating oil discharging through the oil discharging groove to the second oil guiding holes of the flange.

BRIEF DESCRIPTION OF THE DRAWINGS

The above objects and advantages of the present invention will become apparent by describing in detail a preferred embodiment thereof with reference to the accompanying drawings in which.

DETAILED DESCRIPTION OF THE INVENTION

Figure 1:
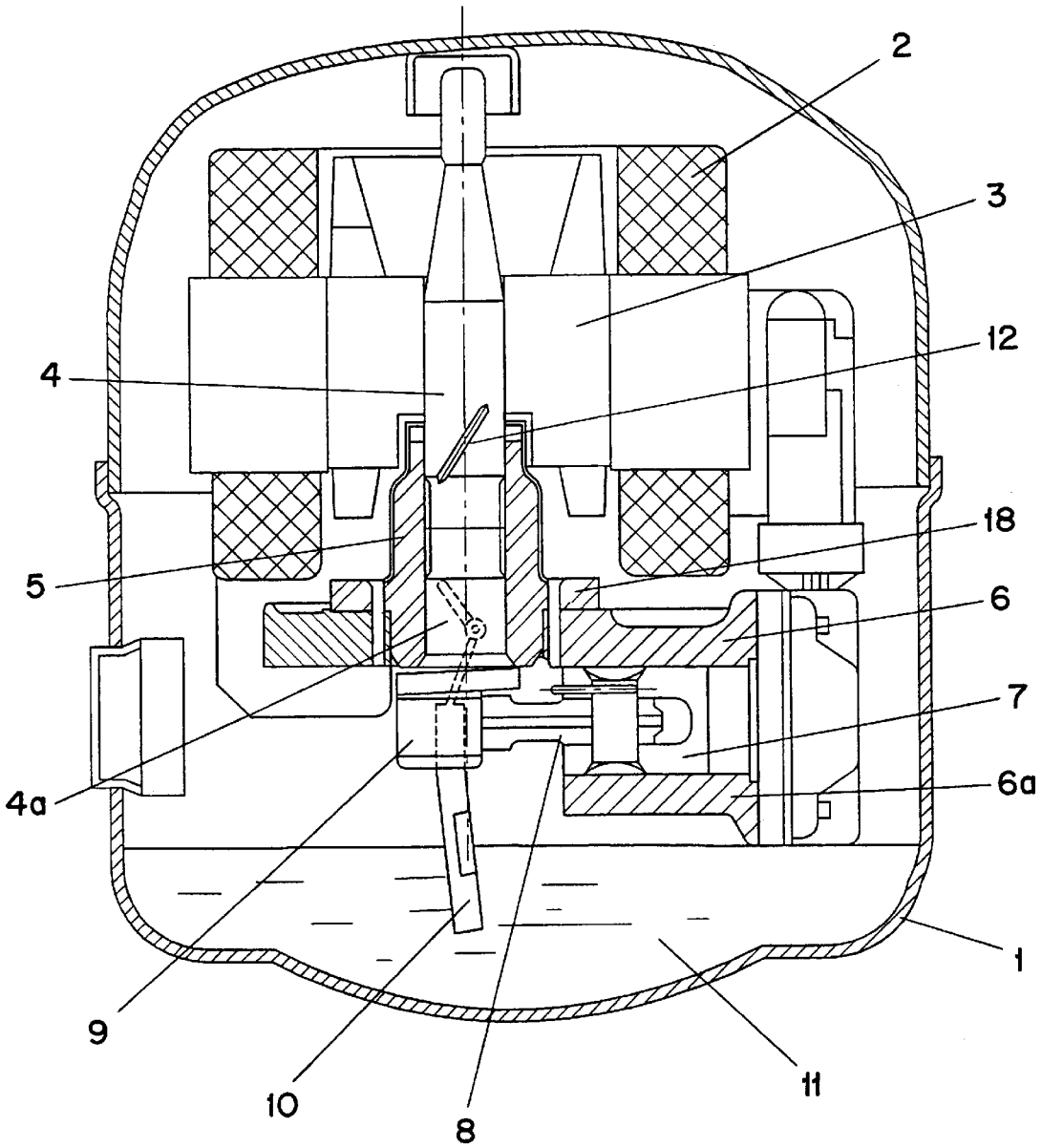
FIG. 1 shows a section of a hermetic reciprocating compressor according to the present invention.

Referring to FIG. 1, a hermetic reciprocating compressor according to the present invention includes a hermetic casing 1, a cylinder apparatus installed inside the casing 1 and a driving motor for driving the cylinder apparatus.

The driving motor includes a stator 2 installed inside the casing 1, a rotor 3 rotatably installed inside the stator 2 and a rotating shaft 4 fitted into the rotor 3 and rotating therewith. The lower portion of the rotating shaft 4 is formed with a journal 4*a*, which slidingly contacts with the inner surface of a sliding bearing 5 to support a rotational movement of the rotating shaft 4.

An eccentric portion 9 is connected to the lower end portion of the rotating shaft 4 and rotates therewith. An oil pickup tube 10 is extended downwardly from the eccentric portion 9 to pick up a lubricating oil contained in an oil container 11 provided at the bottom of the casing 1 and supply the oil between tilt journal 4*a* of the rotating shaft 4 and the bearing 5. The lower end portion of the oil pickup tube 10 is submersed into the lubricating oil contained in the oil container 11. When the rotating shaft 4 rotates, the oil pickup tube 10 rotates to pick up the oil contained in the oil container 11 and supplies the oil between the journal 4*a* and the bearing 5.

An oil groove 12 is formed at the upper portion of the journal 4*a* of the rotating shaft 4 to guide the upward flow of the oil which is picked up by the oil pickup tube 10.

The cylinder apparatus includes a cylinder block 6 which is provided with a cylinder 6*a* and a piston 7 reciprocating inside the cylinder 6*a* to compress the refrigerant. The piston 7 is coupled with the eccentric portion 9 of the rotating shaft 4 through a connecting rod 8 and reciprocates inside the cylinder 21 when the rotating shaft 4 rotates. The bearing 5 is installed on the cylinder block 6.

Figure 2:
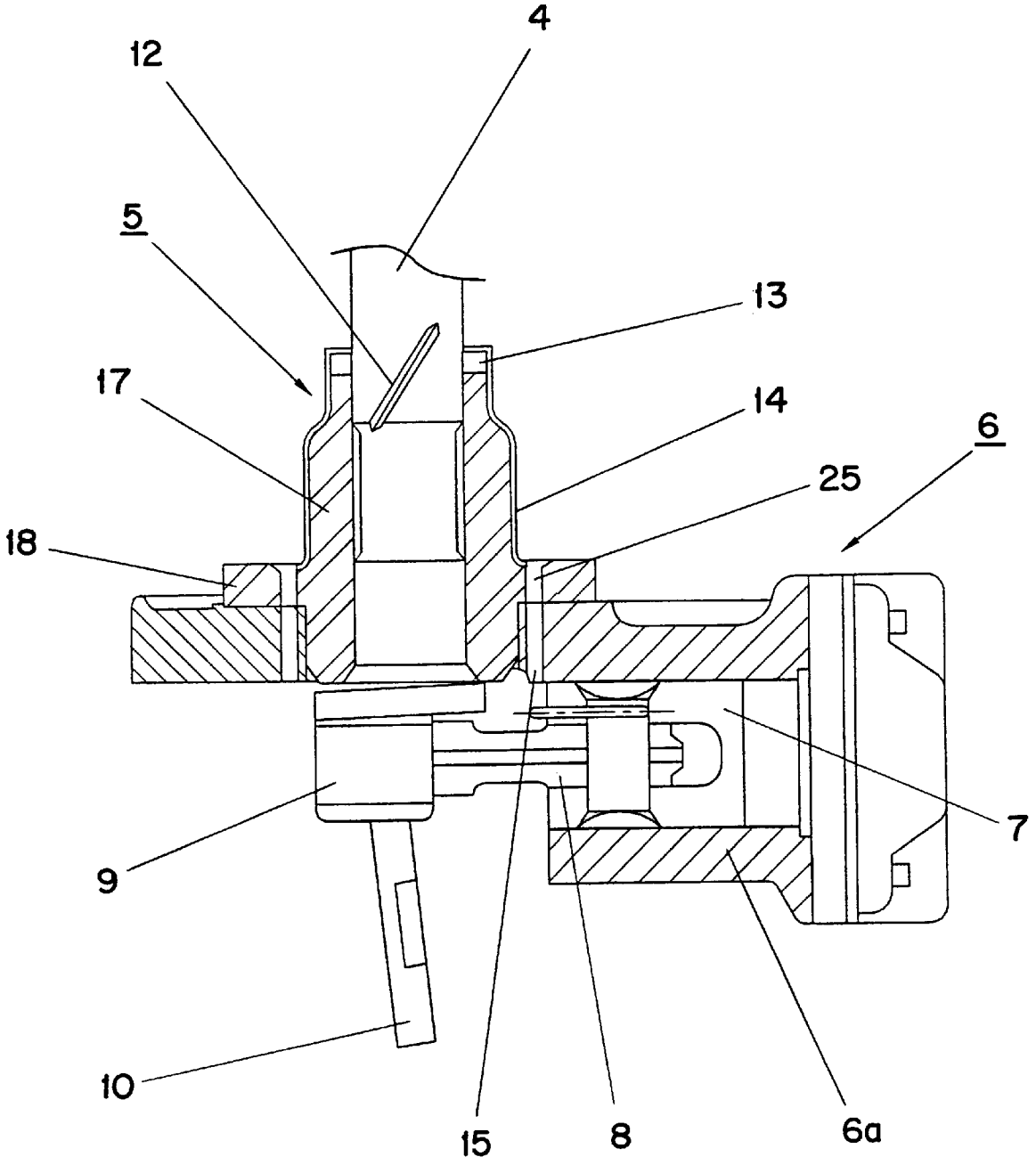
FIG. 2 shows a partial enlarged view of the compressor in FIG. 1.
Figure 3:
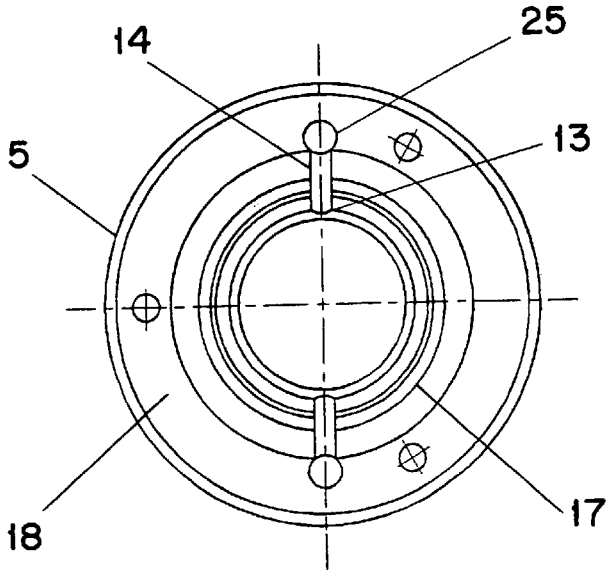
FIG. 3 shows a plan view of a bearing for use with the compressor in FIG. 1.
Figure 5:
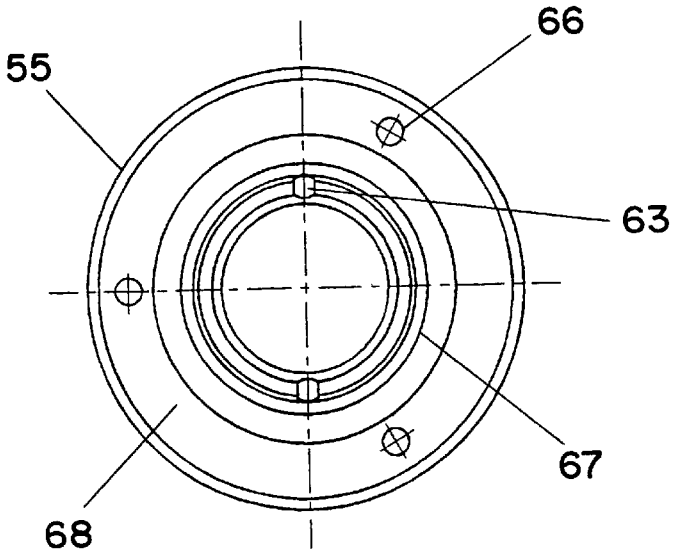
FIG. 5 shows a section of a bearing for use with the conventional hermetic reciprocating compressor.
Figure 4:
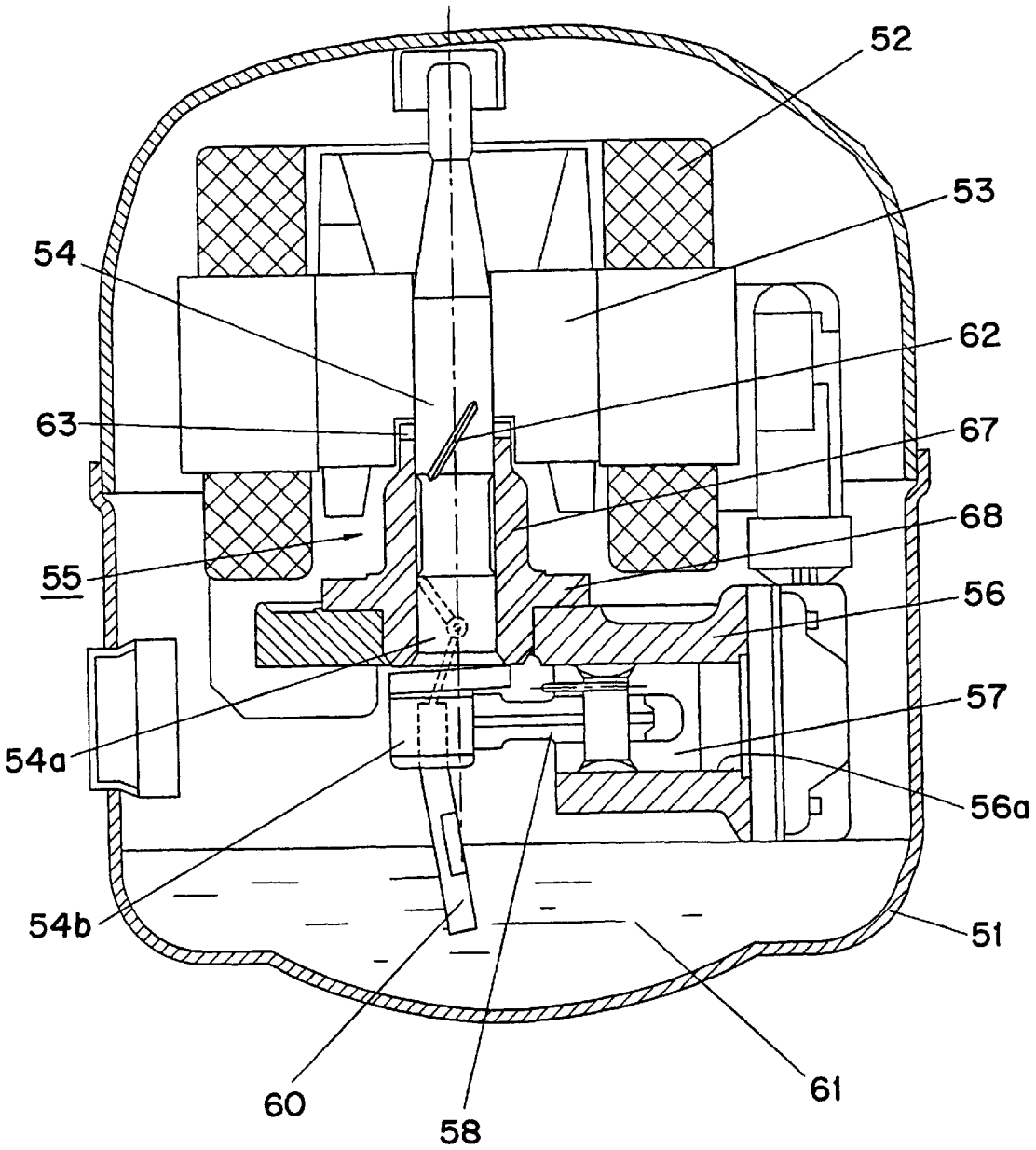
FIG. 4 shows a section of a conventional hermetic reciprocating compressor.

Referring to FIGS. 2 and 3, the bearing 5 has a cylindrical bearing body 17 for supporting the rotation of the journal 4*a* of the rotating shaft 4 and a flange 18 formed at a lower portion of the bearing body 17. The flange 18 is screw-coupled onto the cylinder block 6 to fix the bearing 5 with respect to the cylinder block 6. Oil discharging grooves 13 are formed at the upper end portion of the bearing 5 to discharge the oil which flows upward through the bearing 5.

First oil guiding holes 15 are formed at the Upper portion of the cylinder block 6*a*, which contacts Ad with the flange 18 of the bearing 5. Second oil guiding holes 25 are formed at the flange 18 of the bearing 5, corresponding to the first oil guiding holes 15 of the cylinder block 6. The upper end portion of the second oil guiding holes 25 are of a funnel shape to enhance the oil guiding function thereof. Oil guiding grooves 14 are formed on the outer surface of the bearing 5 to guide the oil which is discharged through the oil discharging grooves 13 to the second oil guiding holes 25. According to this structure, collection and boiling of the oil on the cylinder block 6 can be prevented and therefore noises and deterioration of the oil can be prevented.

At least one of the first oil guiding holes 15 is located stitch that the oil returning to the oil container 11 is directed to the connecting, rod 8. Accordingly, the returning oil can be easily transferred to the piston 7 and the eccentric portion 9 of the rotating shaft 4.

Hereinafter, the flow of the oil in the above-structured compressor will be described.

When the rotating shaft 4 rotates by the actuation of the driving motor to rotate the eccentric portion 9, the oil is picked up from the oil container 11 through the oil pickup tube 10 and is supplied between the journal 4*a* of the rotating shaft 4 and the bearing 5. The oil flows upward along the oil groove 12 while performing the lubricating and cooling function and then is discharged outward through the oil discharging grooves 13 formed at the upper end portion of the bearing 5. The discharged oil flows down along the oil guiding grooves 14 toward the second oil guiding holes 25 of the flange 18. At this time, the oil guiding grooves 14 function to collect the oil and facilitate the downward flow of the oil into the second oil guiding holes 25. The oil passes through the second and first oil guiding holes 25 and 15 and drops into the oil container 11. At this time, part of the oil drops onto the connecting rod 8 and is transferred to the piston 7 and the eccentric portion 9 of the rotating shaft 4, to thereby perform the lubricating and cooling function with respect to the connecting rod 8, the piston 7 and the eccentric portion 9.

As described above, according to the hermetic reciprocating compressor of the present invention, the collection and boiling of the oil on the cylinder block can be prevented, thereby preventing noises and deterioration of the oil. Furthermore, part of the oil returning to the oil container is directly transferred to the connecting rod, the piston and the eccentric portion of the rotating shaft, thereby enhancing the lubricating efficiency.

What is claimed is:

1. A hermetic reciprocating compressor comprising:

a hermetic casing formed with an oil container at the bottom thereof;

a driving motor, having a stator, installed inside said casing, a rotor rotatably installed inside said stator and a rotating shaft rotating with said rotor, said rotor having a journal and an eccentric portion;

a bearing for supporting the rotation of said journal of said rotating shaft, said bearing having a flange formed at a lower portion thereof, and a radial discharge groove formed at an upper end thereof for discharging oil;

an oil pickup device extending downward from a lower end portion of said eccentric portion, for supplying a lubricating oil contained in said oil container between said journal of said rotating shaft and said bearing, the oil being discharged through said discharge groove; and a medium compressing portion having a cylinder block which is provided with a cylinder, a piston reciprocating inside a bore of said cylinder and a connecting rod for connecting said piston to said eccentric portion of said rotating shaft to convert rotational movement of said rotating shaft into reciprocating movement of said piston, said bore having an open rear end, said flange mounted on said cylinder block, wherein said cylinder block has at least one first oil guiding hole including an upper end for receiving oil, and a lower end for discharging the oil;

wherein said flange has at least one second oil guiding hole including an upper end for receiving oil, and a lower end communicating with said upper end of a respective first oil-guiding hole;

wherein at least one oil guiding groove is formed in an outer surface of said bearing and including an upper end for receiving oil from said discharge groove, and a lower end communicating with said upper end of said second oil guiding hole.

2. The hermetic reciprocating compressor as claimed in claim 1 wherein said at least one first oil guiding hole is located such that the lubricating oil discharged therefrom drops toward said connecting rod.

3. The hermetic reciprocating compressor according to claim 1 wherein said at least one first oil guiding hole is located adjacent said open rear end of said bore of said cylinder.

* * * * *